United States Patent [19]

Swimley

[11] 4,074,396

[45] Feb. 21, 1978

[54] CLASP WITH ENCLOSED PIN

[75] Inventor: Ronald N. Swimley, Phoenix, Ariz.

[73] Assignee: Siron Industries, Inc., Phoenix, Ariz.

[21] Appl. No.: 727,298

[22] Filed: Sept. 27, 1976

Related U.S. Application Data

[63] Continuation-in-part of Ser. No. 567,183, April 11, 1975, abandoned.

[51] Int. Cl.[2] ..... A44B 9/00

[52] U.S. Cl. ..... 24/162

[58] Field of Search ..... 24/72.5, 162, 171, 238, 24/239, 260, 255 TC, 255 G, 255 TV, 263 SW, 263 PJ, 263 FC, 263 P, 194, 136 R, 158 R, 158 S

[56] References Cited

U.S. PATENT DOCUMENTS

| | | | |
|---|---|---|---|
| 267,498 | 11/1882 | Cox | 24/72.5 |
| 2,701,402 | 2/1955 | Foster | 24/239 |
| 3,136,015 | 6/1964 | Gunderson | 24/162 |
| 3,296,668 | 1/1967 | Aiken | 24/72.5 |

*Primary Examiner*—Paul R. Gilliam
*Assistant Examiner*—Kenneth J. Dorner
*Attorney, Agent, or Firm*—Warren F. B. Lindsley

[57] ABSTRACT

An improved clasp for holding fabric between its legs employing an axially movable pin within the clasp for penetrating the fabric when moved to engage a catch which conceals the end of the pin within the clasp.

2 Claims, 8 Drawing Figures

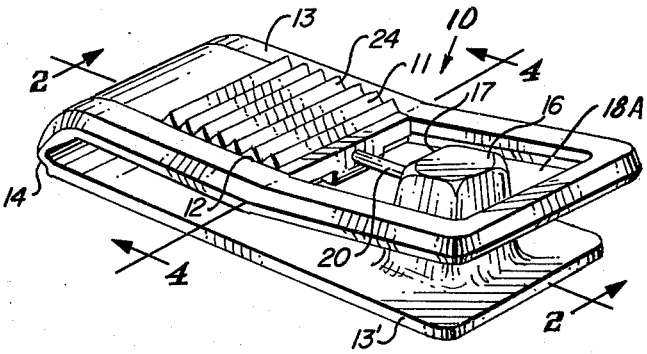
FIG-1
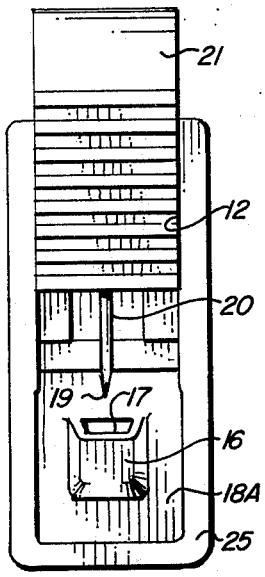
FIG-3
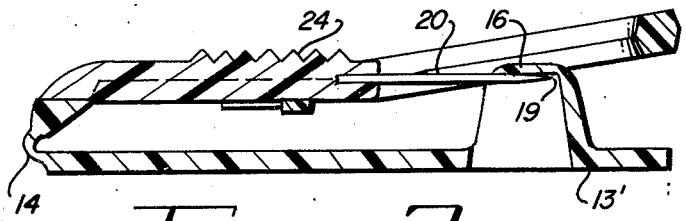
FIG-2
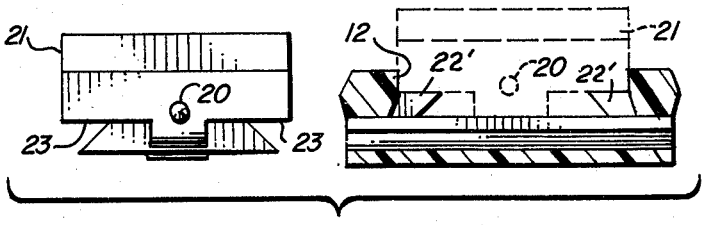
FIG-4
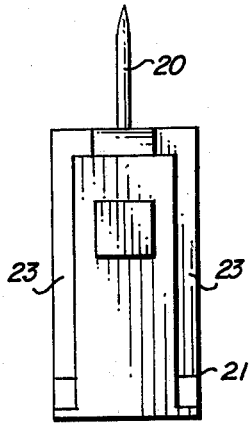
FIG-5
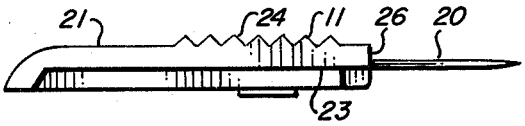
FIG-6
FIG-7
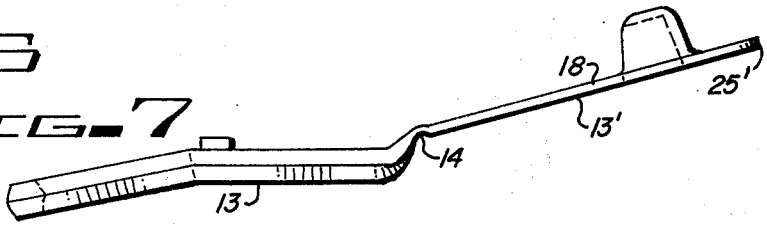
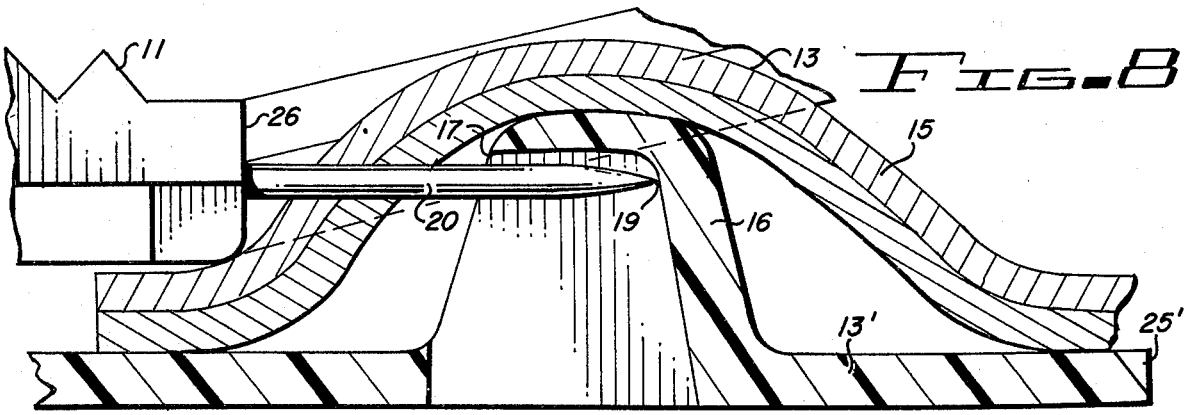
FIG-8

CLASP WITH ENCLOSED PIN

This application is a continuation in part of U.S. Application, Ser. No. 567,183, now abandoned, filed Apr. 11, 1975 and entitled CLASP WITH ENCLOSED PIN.

BACKGROUND OF THE INVENTION

Pins and clasps have been used for holding together more than one layer of fabric and particularly when fastening diapers to babies.

When used for diapers, the fastening means must be quick, easily and skillfully handled so as to avoid sticking the baby or mother, must firmly hold the fabric ends together under the stress and strains of baby movement, must hold equally well thin as well as thick fabric materials and is rust resistant.

Although many types of pins and clasps have been provided before and after the conception of the safety pin, none have been completely satisfactory. The pins have always provided an opportunity for sticking the seamstress or the user and baby being diapered. The clasps have failed to hold firmly under baby movement. Accordingly, a need exists for a new clasp which embodies the benefits of the clasp and safety pin.

SUMMARY OF THE INVENTION

In accordance with the invention claimed, a new and improved clasp is provided which has partially concealed within the legs of the clasp a pin for interlocking the fabric engaged between legs of the clasp so as to provide a dual fastening function. The pin forms a part of a sliding member mounted for longitudinal movement along a track within or on the outer surface of one of the legs of the clasp. The pointed end of the pin penetrates the fabric captured between the legs of the clasp as it moves into interlocking engagement with a catch within the clasp. Thus, the pin is shielded by the legs of the clasp within the outline of the clasp when in fabric engaging or disengaging positions.

It is, therefore, one object of this invention to provide a new and improved fastening means.

Another object of this invention is to provide a new and improved clasp type fastening means employing a pin for engaging and disengaging the material gripped between the legs of the clasp.

Another object of this invention is to provide a new and improved dual functioning clasp employing a pin mounted for movement longitudinally thereof within the periphery of the clasp for penetrating in a locking position the material gripped by the clasp.

A further object of this invention is to provide a new and improved clasp employing a pin movable longitudinally of its length within the confines of the legs of the clasp wherein the end of the pin is shielded from the user in its material engaging position by its catch forming a part of the clasp.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawing, in which:

FIG. 1 is a perspective view of a new and improved clasp incorporating the present invention;

FIG. 2 is a cross-sectional view of FIG. 1 taken along the line 2–2;

FIG. 3 is a top view of the clasp shown in FIG. 1;

FIG. 4 is a cross-sectional view of FIG. 1 taken along the line 4–4 in exploded form to more clearly illustrate the moving member and track within which it moves;

FIG. 5 is a bottom view of movable member shown in FIGS. 1–4;

FIG. 6 is a side view of the movable member shown in FIG. 5;

FIG. 7 is an enlarged stretched out view of the legs of the clasp illustrating in more detail the hinge portion thereof; and FIG. 8 is an enlarged partial view of the pin catch engaging portion of the clasp.

DESCRIPTION OF THE PREFERRED EMBODIMENT

Referring more particularly to the drawing by characters of reference, FIG. 1 discloses a U-shaped clasp 10 employing a movable pin mechanism 11 slidable within a track 12 formed in the outside surface of leg 13 of the clasp. Clasp 10, as shown in the drawing, comprises a pair of legs 13, 13' formed of one piece of material such as plastic which are interconnected by a necked down hinge portion 14 formed of the same material as the legs to form a single body member. Since the clasp is molded when the legs thereof are juxtapositioned to each other, the plastic material of the clasp resiliently biases legs 13, 13' toward each other, thereby forming a clasping or gripping action of material 15 placed between the legs of the clasp as shown in FIG. 8.

It should be noted particularly from FIGS. 7 and 8 of the drawing that leg 13' is provided with a dome shaped protrusion 16 having an opening 17 in its domical configuration. The protrusion extends outwardly of the inner surface 18 of leg 13' and through an opening 18A in leg 13 to form a catch for the end 19 of pin 20 forming a part of the pin mechanism 11.

As noted from FIGS. 1–6 of the drawing pin mechanism 11 comprises a slidable member 21 grooved at 23 for receiving a matching tongue 22' forming a part of track 12 in the surface of leg 13 of the clasp for slidable but frictionally restrained movement longitudinally of leg 13. The restrain is provided by the relatively tight fit between member 21 and track 12 of the clasp. The slidable member 21 is provided with a knurled or ridged surface 24 along at least a part of its outer surface for easily gripping and moving member 21 along track 12 formed in the outer surface of leg 13.

Pin 20 is partially embedded in and longitudinally of slidable member 21 so that its end 19 may be moved into and retracted out of the opening 17 in the dome shaped protrusion 16.

With the pin retracted from its catch formed by the dome shaped protrusion 16, the material 15 to be gripped and held together by the clasp is forced between the ends 25, 25' of legs 13, 13' over the dome shaped protrusion 16 of leg 13' and toward the hinge 14 interconnecting the engaging ends of legs 13, 13'.

At this point, the slidable member 21 and its pin 20 are slid along track 12 causing the end 19 of the pin to penetrate the material 15 and coming to rest in the interior of the dome shaped protrusion 16.

As noted from FIG. 8, the pin engaging end 26 of the slidable member 21 moves over the surface of material 15 thereby wedgingly engaging it to aid in keeping the pin in the dome shaped protrusion and the slidable member 21 from moving away from the dome shape protrusion to accidentally release the material from the pin action of the clasp. To release the material from the clasp the slidable member 21 and pin 20 are moved away from protrusion 16.

Although the clasp and its parts, except the pin, are illustrated as being formed of plastic, any suitable material may be used for any one or all of the parts of the clasp.

Although but one embodiment of the invention has been illustrated and described, it will be apparent to those skilled in the art that various modifications and changes may be made therein without departing from the spirit of the invention or from the scope of the appended claims.

What is claimed is:

1. A U-shaped clasp for engaging between its legs material to be held together comprising:

an elongated body member formed in a U-shaped configuration to define a pair of juxtapositioned legs connected together at a common end, a track comprising a tongue and a first groove formed along the outer surface of one of said legs for accepting a member slidable therealong, said tongue and first groove extending along the length of said one of said legs, said one of said legs being provided with a first opening adjacent its free end, a slide member mounted for slidable movement along said track and being provided with a second groove configured for receiving and interlocking with said tongue of said track for preventing lateral movement of said slide member relative to said track, whereby movement of said slide member along said track frictionally restrains said slide member along the full length of said track, a dome shaped protrusion extending from the inner surface of said other leg of said body member for penetrating said first opening in said one of said legs when in a material engaging position, said protrusion being provided with a second opening in alignment with said track, the outside surface of said slide member being ridged to aid in moving the slide member along the track and said slide member being provided with a pin for penetrating said second opening when moved toward said protrusion, whereby material to be gripped by said clasp forced between the common ends of said body member and over said protrusion is wedgingly engaged between said slide member and said other leg and penetrated by said pin as it moves into said protrusion.

2. The U-shaped clasp set forth in claim 1 wherein:

said body member is formed of a strip of plastic necked down at a point between its ends to form a hinge connection of the juxtapositioned legs of the clasp.

* * * * *